US011808085B2

(12) United States Patent
Power, II et al.

(10) Patent No.: US 11,808,085 B2
(45) Date of Patent: Nov. 7, 2023

(54) TREE STICK CLIMBING STICK NESTING SYSTEM

(71) Applicant: Tethrd, Inc., Carver, MN (US)

(72) Inventors: Walter Ernest Power, II, Carver, MN (US); Gregory Alan Godfrey, Richmond Hill, GA (US); Shawn Paul Chadwick, Merrill, WI (US)

( * ) Notice: Subject to any disclaimer, the term of this patent is extended or adjusted under 35 U.S.C. 154(b) by 4 days.

(21) Appl. No.: 17/215,748

(22) Filed: Mar. 29, 2021

(65) Prior Publication Data

US 2022/0305344 A1 Sep. 29, 2022

(51) Int. Cl.
*E06C 1/38* (2006.01)
*A63B 27/00* (2006.01)
*E06C 1/34* (2006.01)

(52) U.S. Cl.
CPC ..... *E06C 1/381* (2013.01); *A63B 27/00* (2013.01); *E06C 1/34* (2013.01)

(58) Field of Classification Search
CPC ... E06C 1/381; E06C 1/10; E06C 1/34; A63B 27/00; A63B 22/00; A01M 31/02
See application file for complete search history.

(56) References Cited

U.S. PATENT DOCUMENTS 24,044 A * 5/1859 Moulton ..... E06C 1/381 182/189
185,203 A * 12/1876 Allen
4,388,983 A * 6/1983 Bartels ..... E06C 1/34 182/189
4,592,446 A * 6/1986 White ..... E06C 1/34 182/189
4,844,207 A * 7/1989 Andrews ..... E06C 1/381 182/189
5,109,954 A * 5/1992 Skyba ..... E06C 1/10 182/189
5,277,273 A * 1/1994 Grimes ..... E06C 1/34 182/116
5,439,072 A * 8/1995 Jenkins, Jr. ..... E06C 7/081 182/100
6,138,792 A * 10/2000 Morris ..... E06C 1/10 182/178.3
D590,068 S * 4/2009 Woller ..... D25/64
7,690,481 B1 * 4/2010 Pederson ..... A01M 31/02 182/133
8,556,035 B1 * 10/2013 Kendall ..... E06C 1/381 182/189
9,512,675 B1 * 12/2016 Fast ..... E06C 1/04
9,732,556 B2 * 8/2017 Priest ..... E06C 1/381
10,301,873 B2 * 5/2019 Priest ..... A01M 31/02
(Continued)

*Primary Examiner* — Colleen M Chavchavadze

(57) ABSTRACT

A tree climbing stick nesting system includes a plurality of tree climbing stick assemblies each including a stick body. A step and a standoff are each attached to the stick body. A coupler is attached to the stick body and releasably secures together a pair of the tree climbing stick assemblies to define secured tree sticks such that longitudinal axes of the secured tree sticks are orientated parallel to each other. The coupler includes a first mating member and a second mating member. The first mating member of one of the tree climbing stick assemblies is vertically engageable with the second mating member of another one of the tree climbing stick assemblies when the stick bodies of the secured tree sticks are vertically orientated.

8 Claims, 18 Drawing Sheets

(56) References Cited

U.S. PATENT DOCUMENTS

| | | | | |
|---|---|---|---|---|
| 10,973,224 | B2 * | 4/2021 | Infalt | G05B 19/182 |
| 11,198,038 | B1 * | 12/2021 | Power, II | A63B 27/00 |
| 2004/0216952 | A1 * | 11/2004 | Woller | A01M 31/00 182/100 |
| 2008/0103637 | A1 * | 5/2008 | Bliven | F16B 2/20 701/1 |
| 2008/0156588 | A1 * | 7/2008 | Butcher | E06C 1/34 182/200 |
| 2012/0125715 | A1 * | 5/2012 | Furseth | E06C 7/081 72/253.1 |
| 2015/0166147 | A1 * | 6/2015 | Clardy | E06C 1/38 182/163 |
| 2018/0073298 | A1 * | 3/2018 | Hand | E06C 1/34 |
| 2019/0055782 | A1 * | 2/2019 | Infalt | B23P 13/02 |
| 2020/0253190 | A1 * | 8/2020 | D'Acquisto | A01M 31/02 |
| 2021/0095524 | A1 * | 4/2021 | Petreman | E06C 1/381 |
| 2021/0205667 | A1 * | 7/2021 | Garis | E06C 1/34 |

* cited by examiner

TREE STICK CLIMBING STICK NESTING SYSTEM

CROSS-REFERENCE TO RELATED APPLICATIONS

Not Applicable+

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tree climbing stick nesting devices and more particularly pertains to a new tree stick nesting assembly and method for allowing a plurality of tree climbing sticks to be attached together in such a manner that their inerlocking forms a secure fit preventing their movement relative to each other and elicits a subsequent reduction in noise during their transportation. Furthermore, the tree climbing sticks will be nested in such a manner that their combined volume will be reduced to facilitate their storage and transportation.

(2) Description of Related Art Including Information Disclosed Under 37 CFR 1.97 and 1.98

The prior art relates to nesting systems and more particularly to those systems used for securing together a plurality of tree climbing sticks. However, these systems do not always securely lock the tree climbing sticks in such a manner that prevents movement and vibration between connected tree climbing sticks. This will cause the tree climbing sticks to impact and move against each other during transportation, i.e. while being carried by a walking end-user, leading to noise being generated from the tree climbing sticks. Since a hunter will desire to remain as quiet as possible, this movement between tree climbing sticks is a disadvantage. Moreover, the connecting means of these systems are not easily manipulated and utilized and thus the nesting of these tree climbing sticks can be onerous and frustrating to their users.

BRIEF SUMMARY OF THE INVENTION

An embodiment of the disclosure meets the needs presented above by generally comprising a plurality of tree climbing stick assemblies each including a stick body having an upper end, a lower end, a front side, and a rear side. The stick body has a longitudinal axis extending through the upper and lower ends. A step is attached to the stick body and is stepped upon and gripped by a user of the tree climbing stick assemblies. A standoff is attached to the stick body and is configured for engaging a surface of a tree. The standoff extends forward of the front side. A coupler is attached to the stick body and releasably secures together a pair of the tree climbing stick assemblies to define secured tree sticks such that the longitudinal axes of the secured tree sticks are orientated parallel to each other. The coupler includes a first mating member and a second mating member. The first mating member of one of the tree climbing stick assemblies is vertically engageable with the second mating member of another one of the tree climbing stick assemblies when the stick bodies of the secured tree sticks are vertically orientated.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
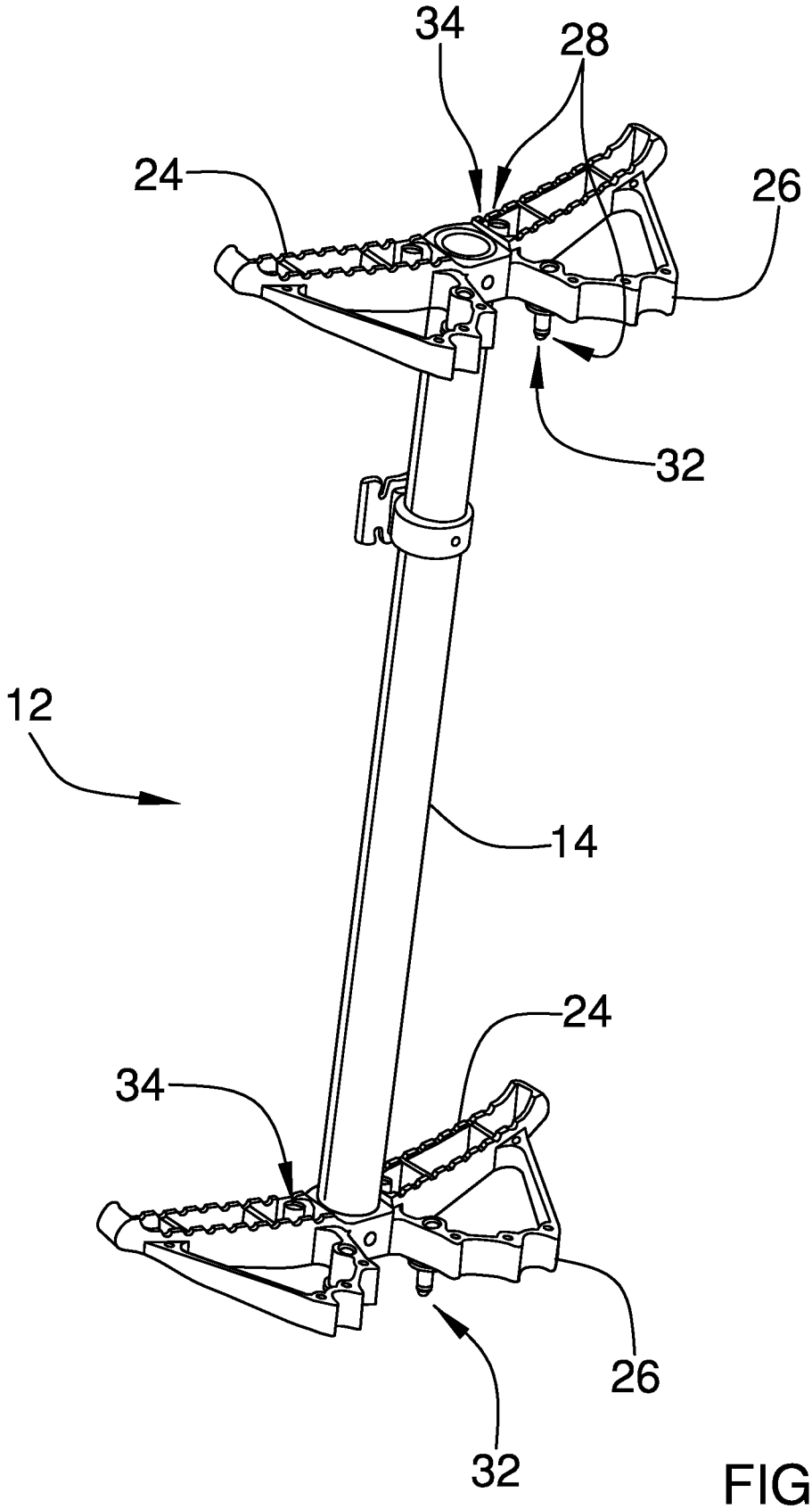
FIG. 1 is a front isometric view of a tree climbing stick nesting system according to an embodiment of the disclosure.
Figure 2:
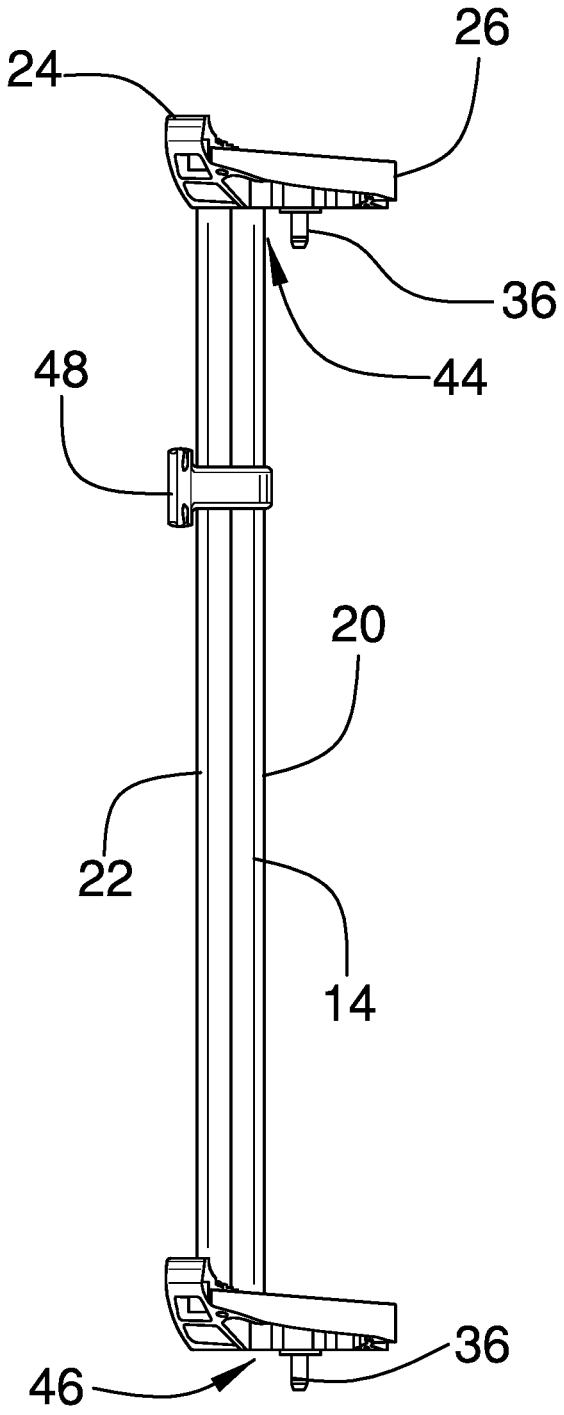
FIG. 2 is a right side view of an embodiment of the disclosure and being a mirror image of a left side view.
Figure 3:
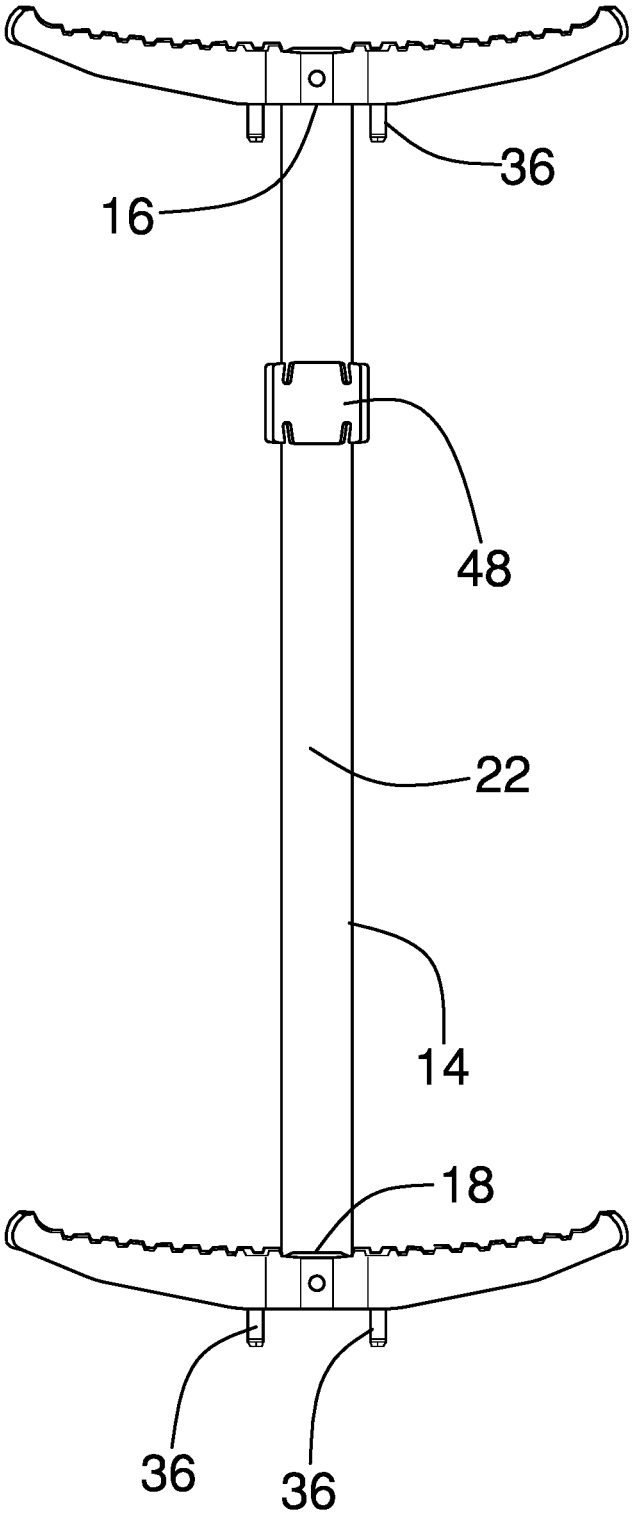
FIG. 3 is a rear view of an embodiment of the disclosure.
Figure 4:
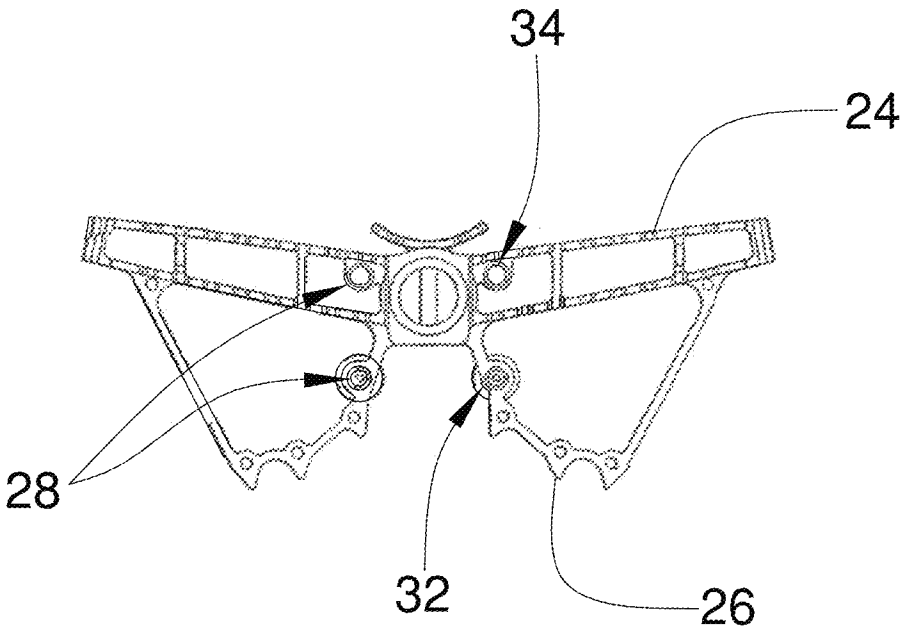
FIG. 4 is a bottom view of an embodiment of the disclosure.
Figure 5:
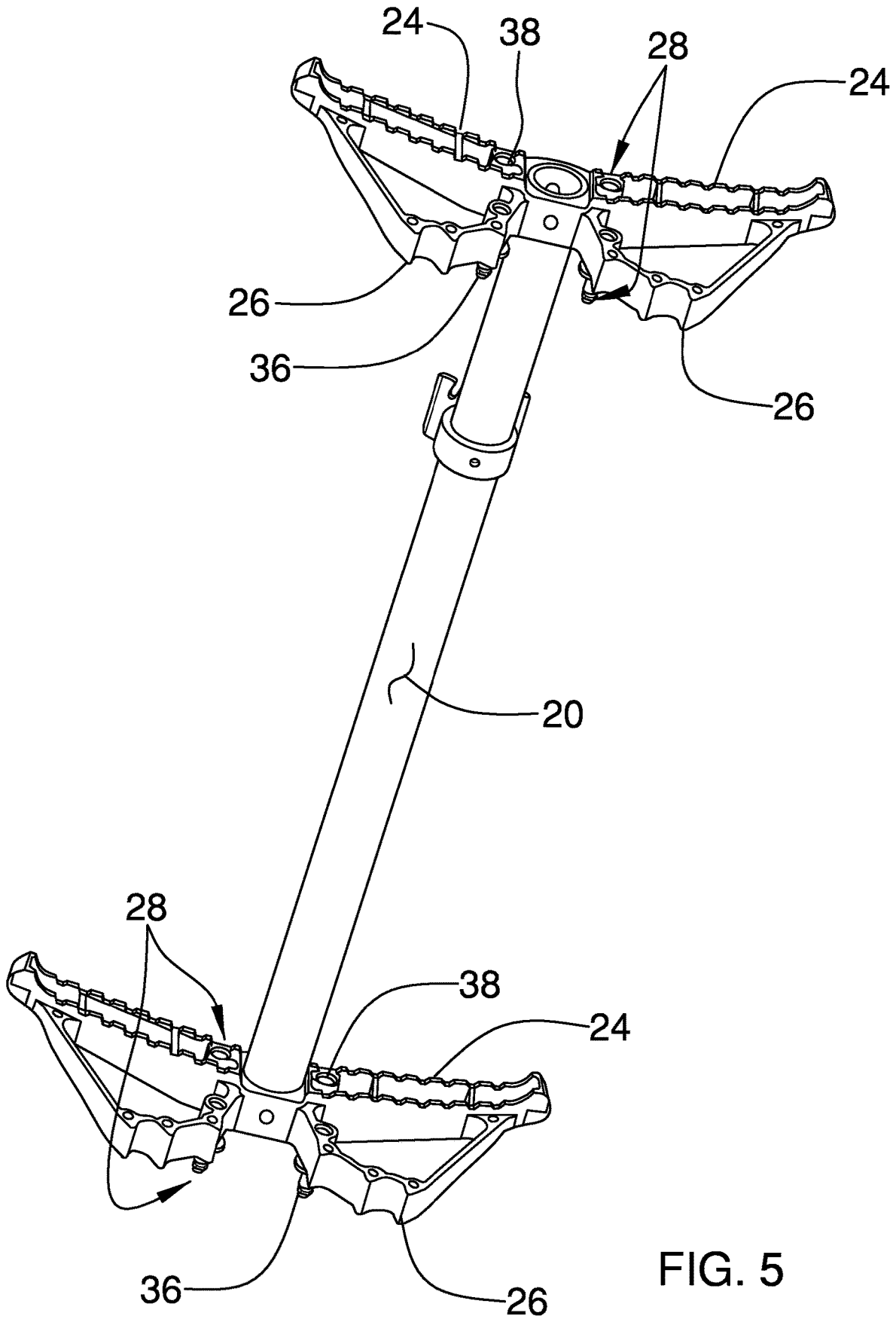
FIG. 5 is a front and top isometric view of an embodiment of the disclosure.
Figure 6:
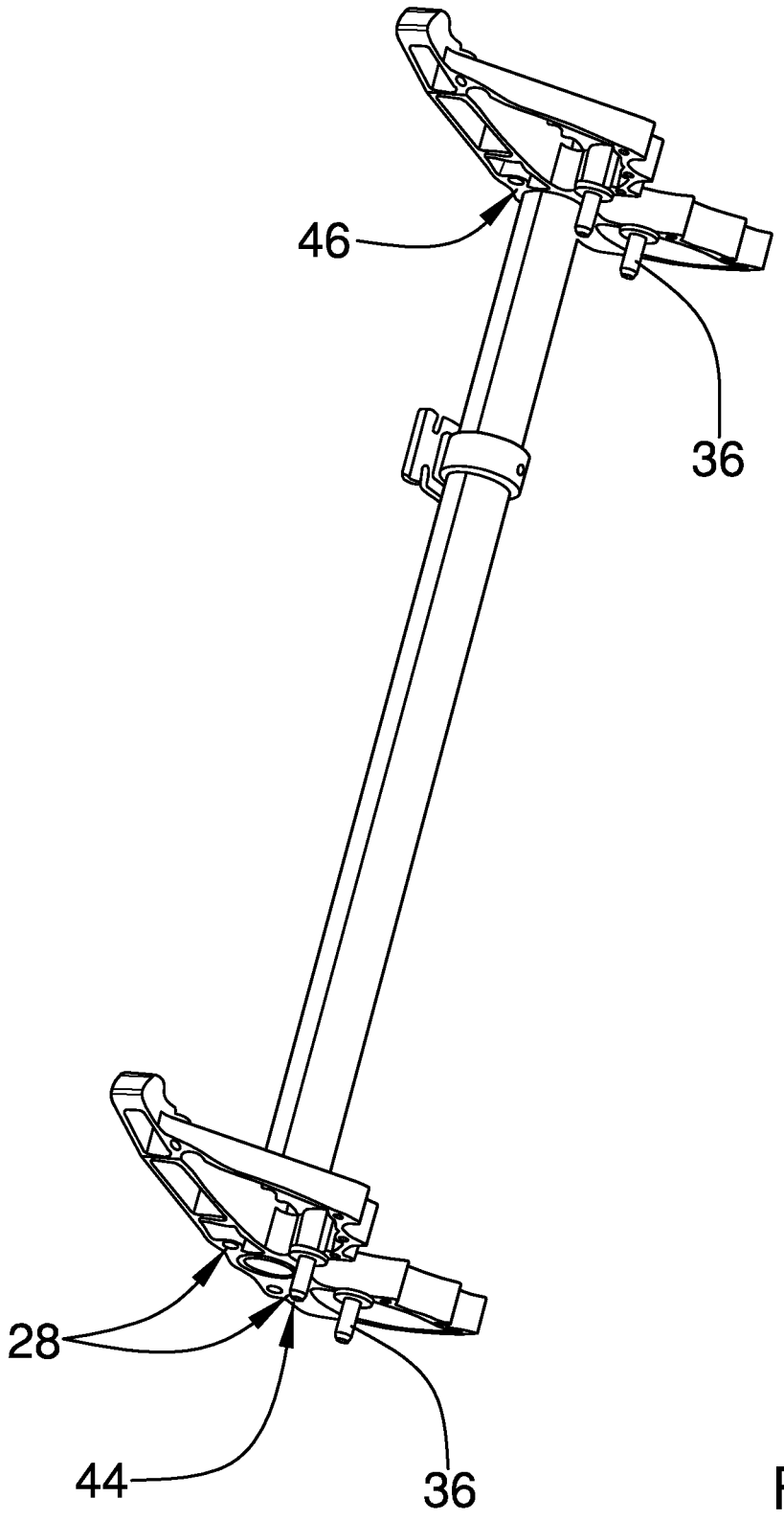
FIG. 6 is a bottom, front isometric view of an embodiment of the disclosure.
Figure 7:
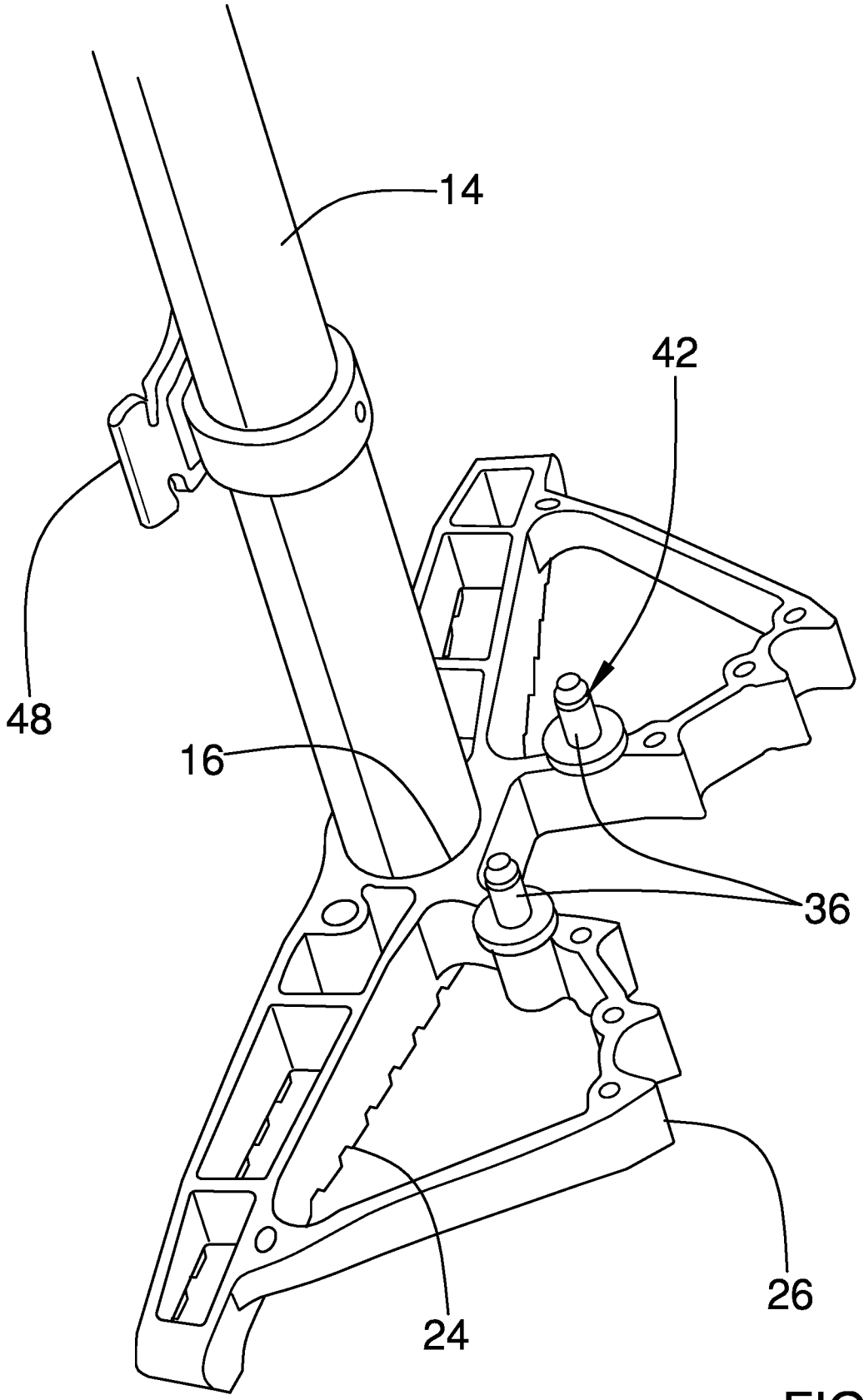
FIG. 7 is a partial bottom isometric view of an embodiment of the disclosure.

With reference now to the drawings, and in particular to FIGS. 1 through 18 thereof, a new tree stick nesting device embodying the principles and concepts of an embodiment of the disclosure and generally designated by the reference numeral 10 will be described.

As best illustrated in FIGS. 1 through 18, the tree climbing stick nesting system 10 generally comprises a tree climbing stick assembly 12 including a stick body 14 that is vertically elongated and has an upper end 16 and a lower end 18. For ease of reference, the stick body 14 also has a front side 20 and a rear side 22 relative to a tree wherein the front side 20 would face a tree upon which the tree climbing stick assembly 12 would be mounted. The stick body 14 may be comprised of any conventional materials used for tree climbing stick assemblies 12. These materials are typically strong and lightweight materials such as metal alloys, plastics, carbon fiber and the like. The stick body 14 will typically have a height from 12" to 36" and has a longitudinal axis which extends through the upper 16 and lower 18 ends.

As with conventional tree climbing stick assemblies 12, the system 10 includes stick bodies 14 with at least one step 24 and at least one standoff 26 attached to the stick body 14. The step 24 is used for both stepping upon and for gripping by a person using the system 10 to climb a tree and therefore may also be known as a "handhold." The standoff 26 engages the tree to place the stick body 14 in a spaced relationship with the tree and therefore extends forward of the front side 20. The standoff 26 may therefore include gripping cleats to frictionally engage a tree while the steps 24 may also include protrusions to enhance friction between the step 24 and a user's footwear and hands. The embodiments provided for in the Figures are only an example of the steps 24 and standoffs 26 which may be provided for in multiple configurations, some of which are explained below, that are widely used in the art of tree climbing stick assemblies.

The steps 24 of tree climbing stick assemblies 12 be formed as single steps extending in one direction, generally laterally, away from the stick body 14 or may include dual wings extending in two directions away from the stick body 14. FIGS. 1-11 include a dual wing type design while FIGS. 12-18 include single steps. The single step designs, which may be provided in pairs as can be seen in the Figure, also may further allow for pivoting of the steps 24 upwardly and downwardly from stored to deployed positions. Thus, the steps 24 may comprise a static construction relative to the stick body 14 or may include foldable sections that can be pivoted against the stick body 14. As with the steps 24, the standoffs 26 may be provided in any number of conventional shapes configured to engage a tree. Some embodiments of standoffs 26 include a centrally located receiving gap for receiving a portion of the tree. Also, the standoffs 26 may also include either static or collapsible/foldable structures. In some embodiments, the standoffs 26 and steps 24 are combined in a single structure either including a unitary structure or components secured together. While the stick body 14 may include any number of steps 24 and standoffs 26, some embodiments, such as those shown in the Figures, include a pair of each and are separated from each other vertically along the stick body 14. The standoffs 26 and steps 24 may be comprised of the same materials used for the stick body 14 and other conventional tree climbing stick assemblies 12.

The system 10 provides for each of the tree climbing stick assemblies to include a coupler 28 being attached to the stick body. The coupler 28 is used to releasably secure together a pair of the tree climbing stick assemblies 12 such that they are defined as secured tree sticks 30 shown in FIGS. 10, 11, 16 and 17. The couplers 28 on other tree climbing stick assemblies 12 thereafter allow for additional tree climbing stick assemblies 12 to be attached to the secured tree sticks 30. When coupled together, the longitudinal axes of the secured tree sticks 30, and any additional tree climbing stick assemblies 12 coupled thereto, are orientated parallel to each other and typically positioned forward or rearward of each other as is shown in the Figures.

The coupler 28, more particularly, includes a first mating member 32 and a second mating member 34. The first mating member 32 of one of the tree climbing stick assemblies 12 is vertically extendable into the second mating member 34 of the of another one of the tree climbing stick assemblies 12 when the stick bodies 14 of the secured sticks 30 are both vertically orientated. The term "vertically oriented" is only being used a reference direction since, it is understood, that the longitudinal axes of the stick bodies 14 each need to be only orientated in a same direction relative to each other for the couplers 28 of two tree climbing stick assemblies 12 to be engaged with each other. Typically, this will include the stick body 14 longitudinal axes being orientated parallel to each other.

As shown in the embodiment of FIGS. 1-11, the first mating member 32 may include a downwardly extending male mating member such as a post 36 that extends downwardly relative to the upper end 16 such that the post 36 has a bottom end defining a free end. The post 36 will typically be elongated along a line which extends through the bottom end and which is orientated parallel to the longitudinal axis of the stick body 14. However, the post 36 may deviate from parallel by an angle 66 up to 20° in any direction. If the post 36 is angled, it will most likely be angled forwardly or rearwardly away from the stick body 14 longitudinal axis. Furthermore, embodiments are envisioned wherein the post 36 may angled up to 45° though orientations closer to parallel may be preferred as it allows the tree stick climbing assemblies 12 to be vertically aligned and abutting each other during their engagement together. In some embodiments, the first mating member 32 may comprise a pair of posts 36 that each extend downwardly and are orientated parallel to each other. The posts 36 may be laterally spaced from each other though their placement may be altered. While the Figures show that first mating member 32 comprising two posts 36, additional posts 36 may be utilized.

In the embodiment shown in FIGS. 12-18, the first mating member 32 includes posts 36 as described above, but the posts in these embodiments extend upwardly relative to the upper end 16 and include a top end defining the free end. The posts 36 of this embodiment are still orientated parallel to the longitudinal axis of the stick body 14 or may be angled by the angle 66 as described above and are typically within 20° of being parallel. Thus, the posts 36 may be upwardly or downwardly extending relative to the upper end 16 of the associated stick body 14.

Figure 10:
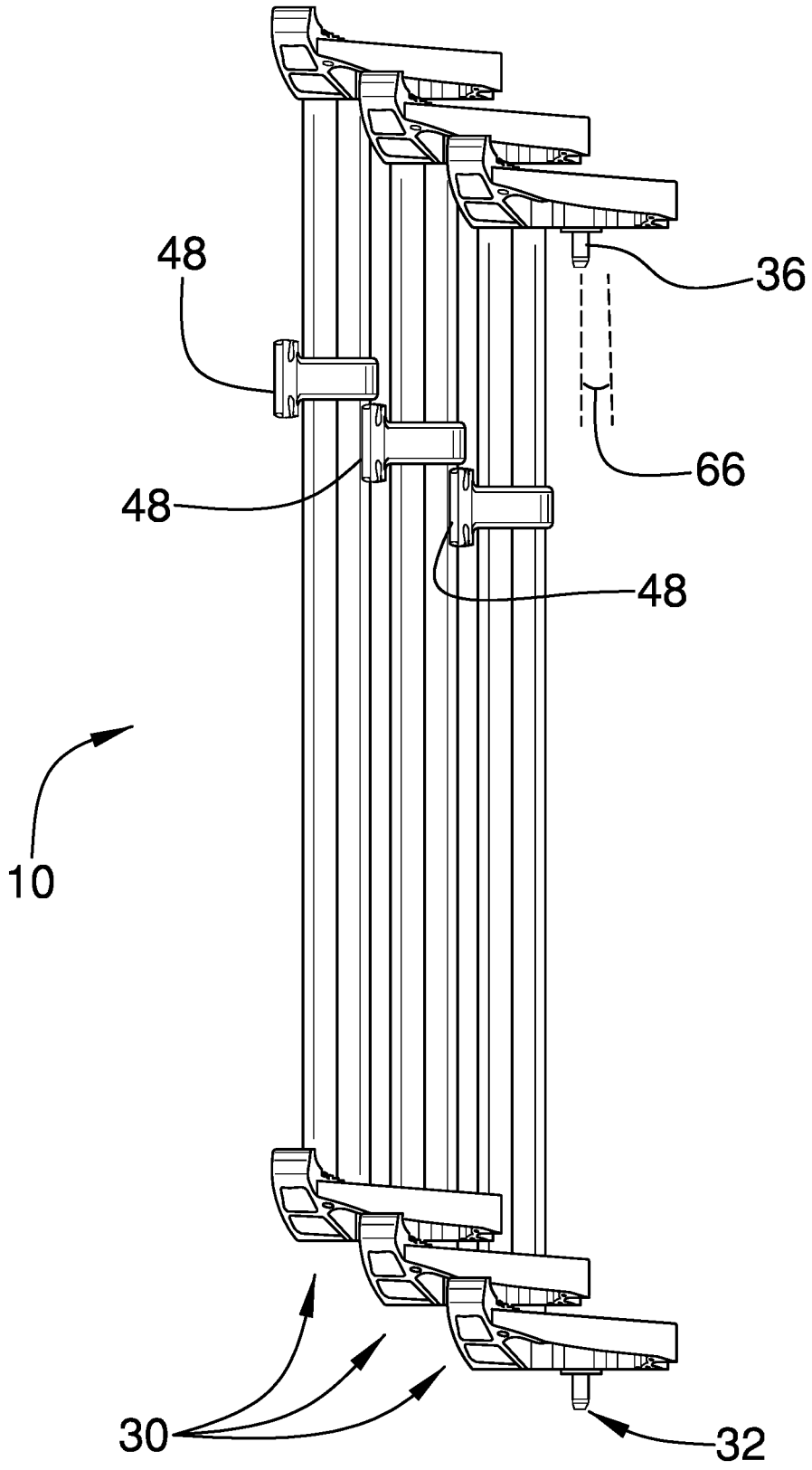
FIG. 10 is side view of an embodiment of the disclosure.
Figure 11:
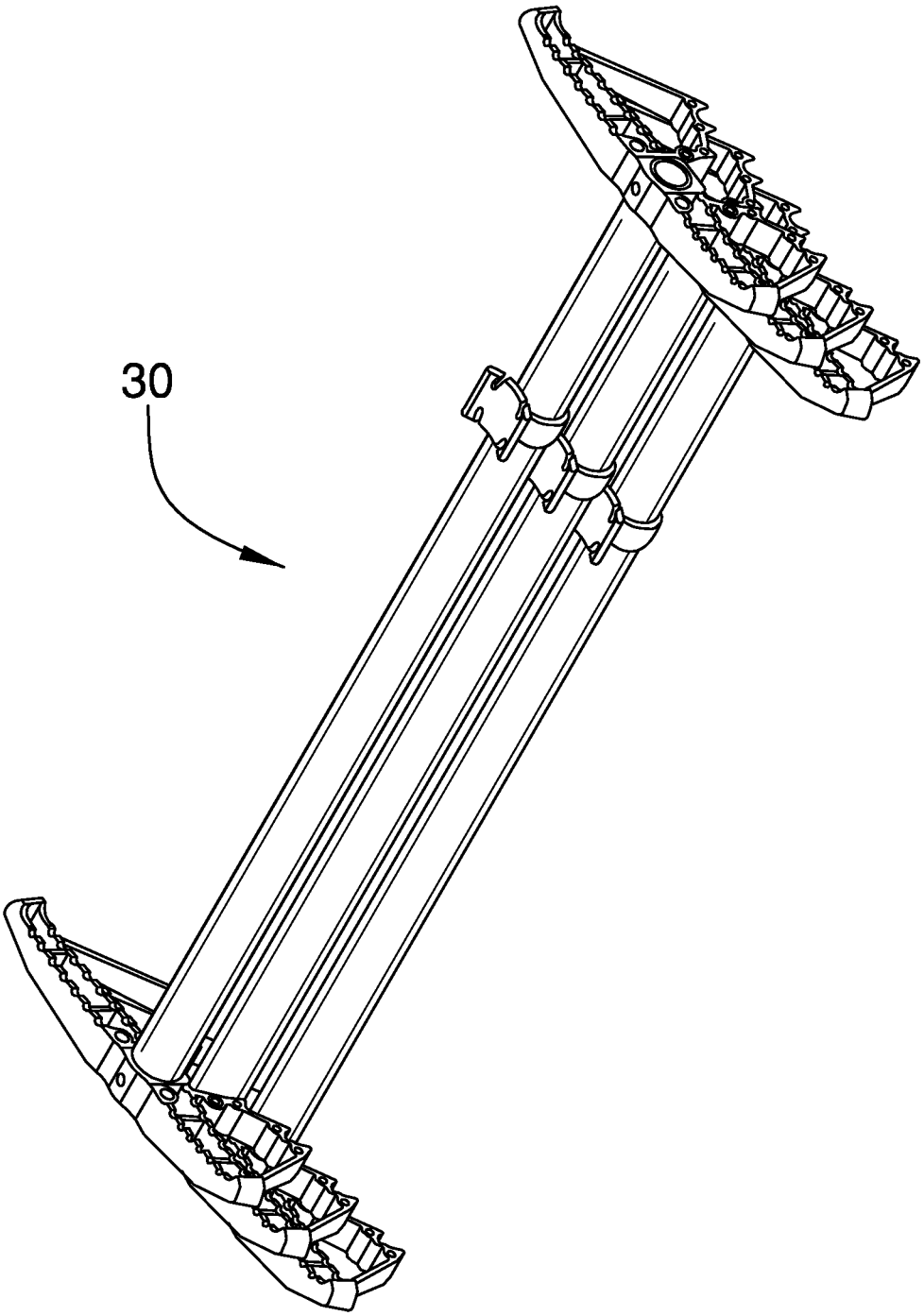
FIG. 11 is a rear and bottom isometric view of an embodiment of the disclosure.
Figure 12:
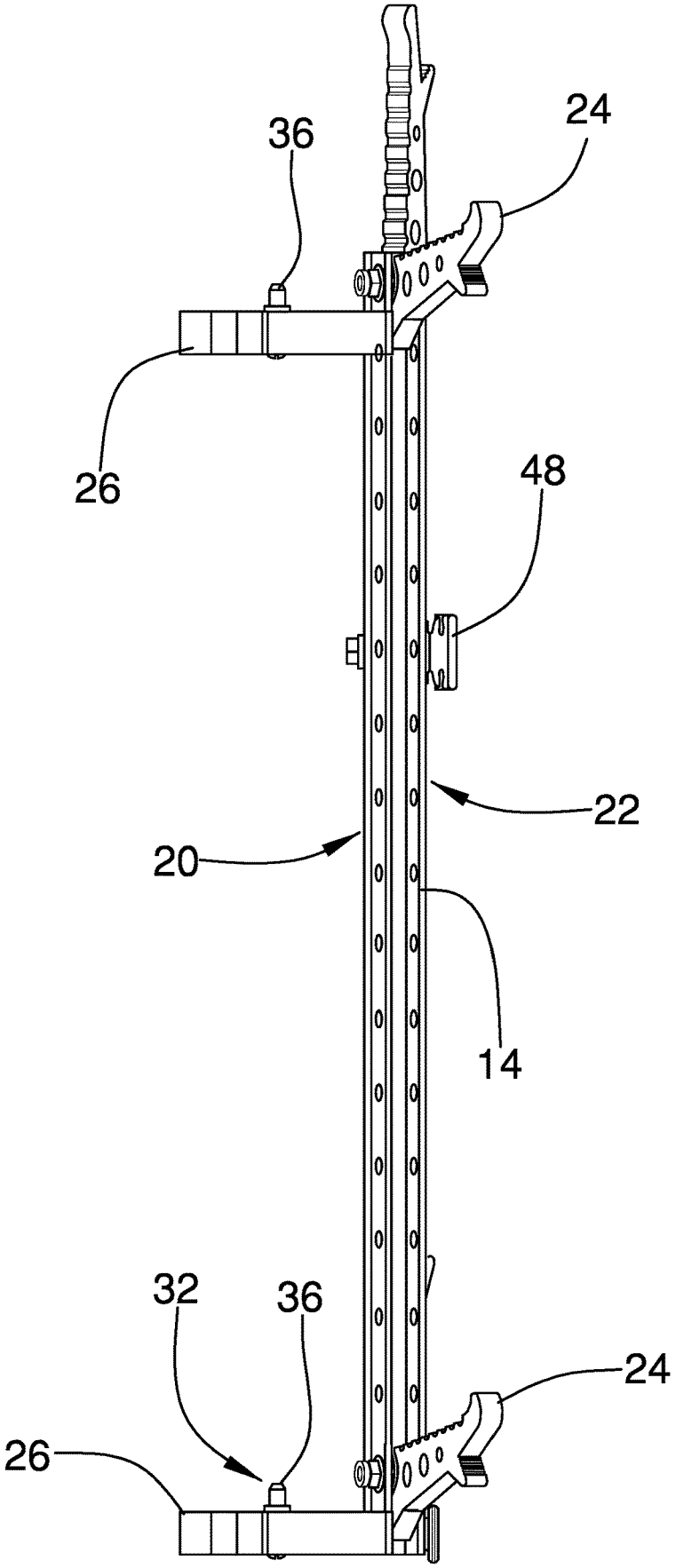
FIG. 12 is a side view of an alternate embodiment of a tree climbing stick assembly of the disclosure.
Figure 13:
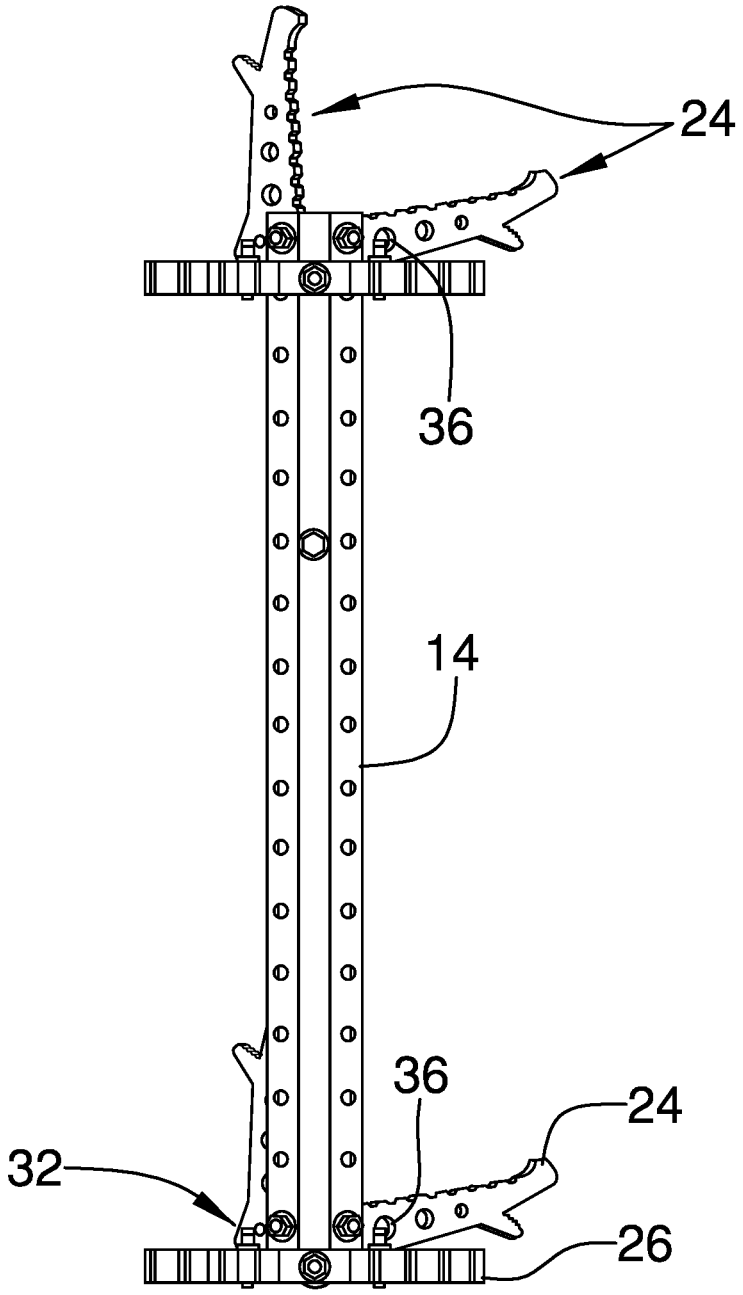
FIG. 13 is a front of the embodiment of the disclosure as shown in FIG. 12.
Figure 14:
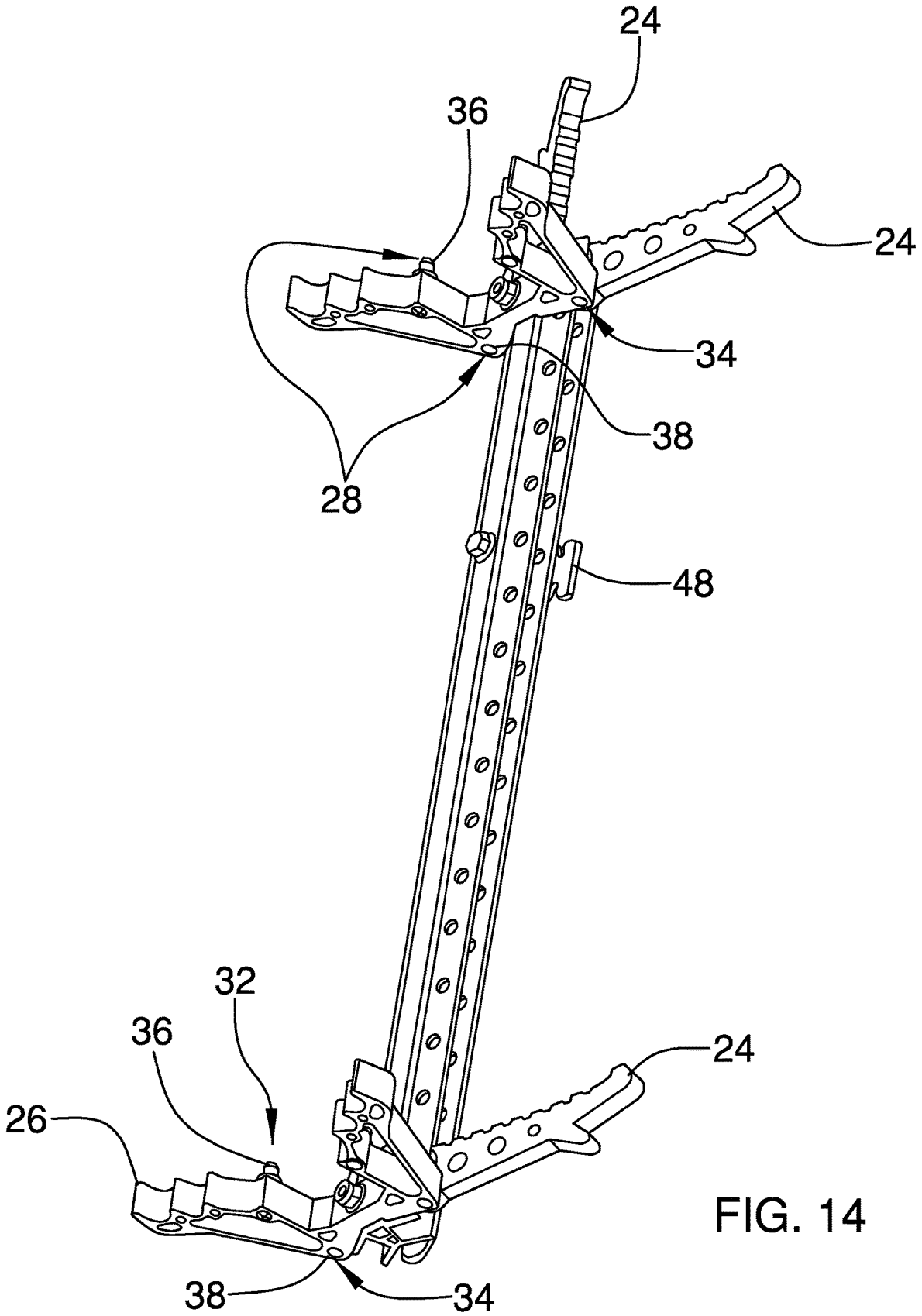
FIG. 14 is a bottom and side isometric view of the embodiment of the disclosure as shown in FIG. 12.
Figure 15:
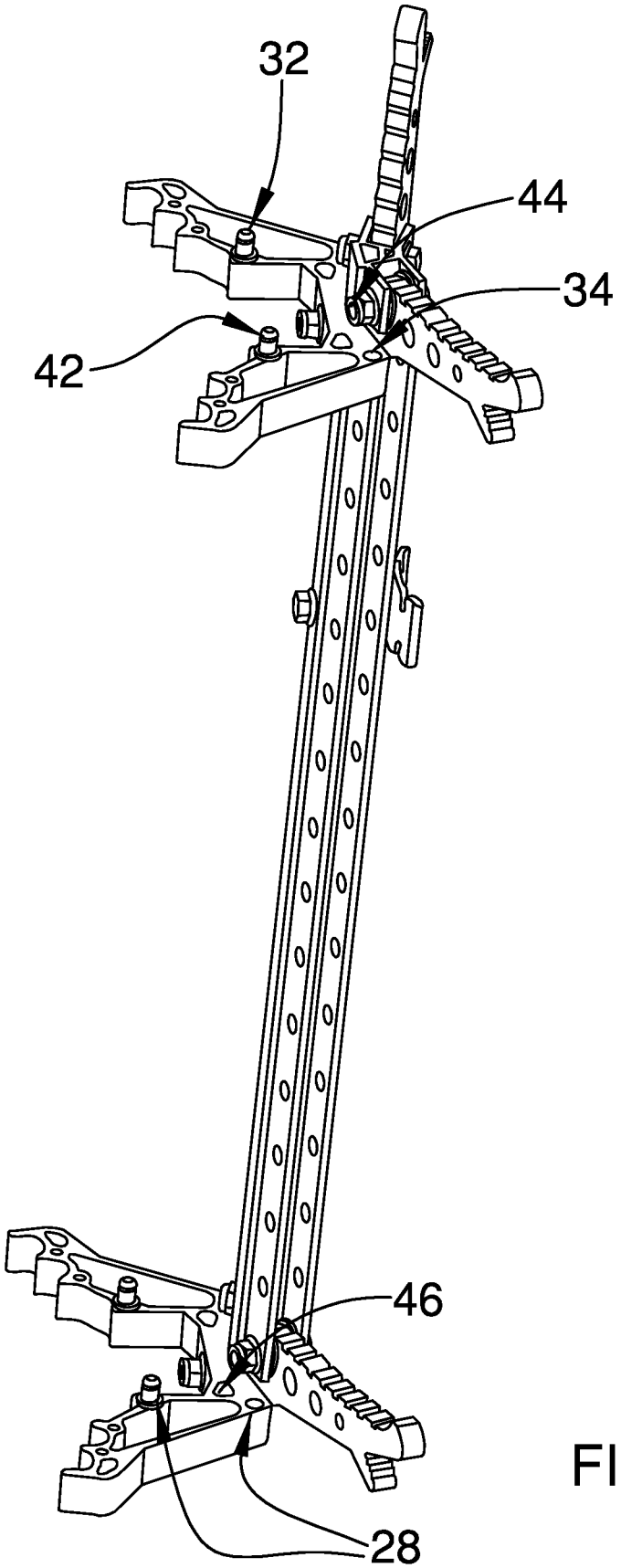
FIG. 15 is a top and side isometric view of the embodiment of the disclosure as shown in FIG. 12.
Figure 16:
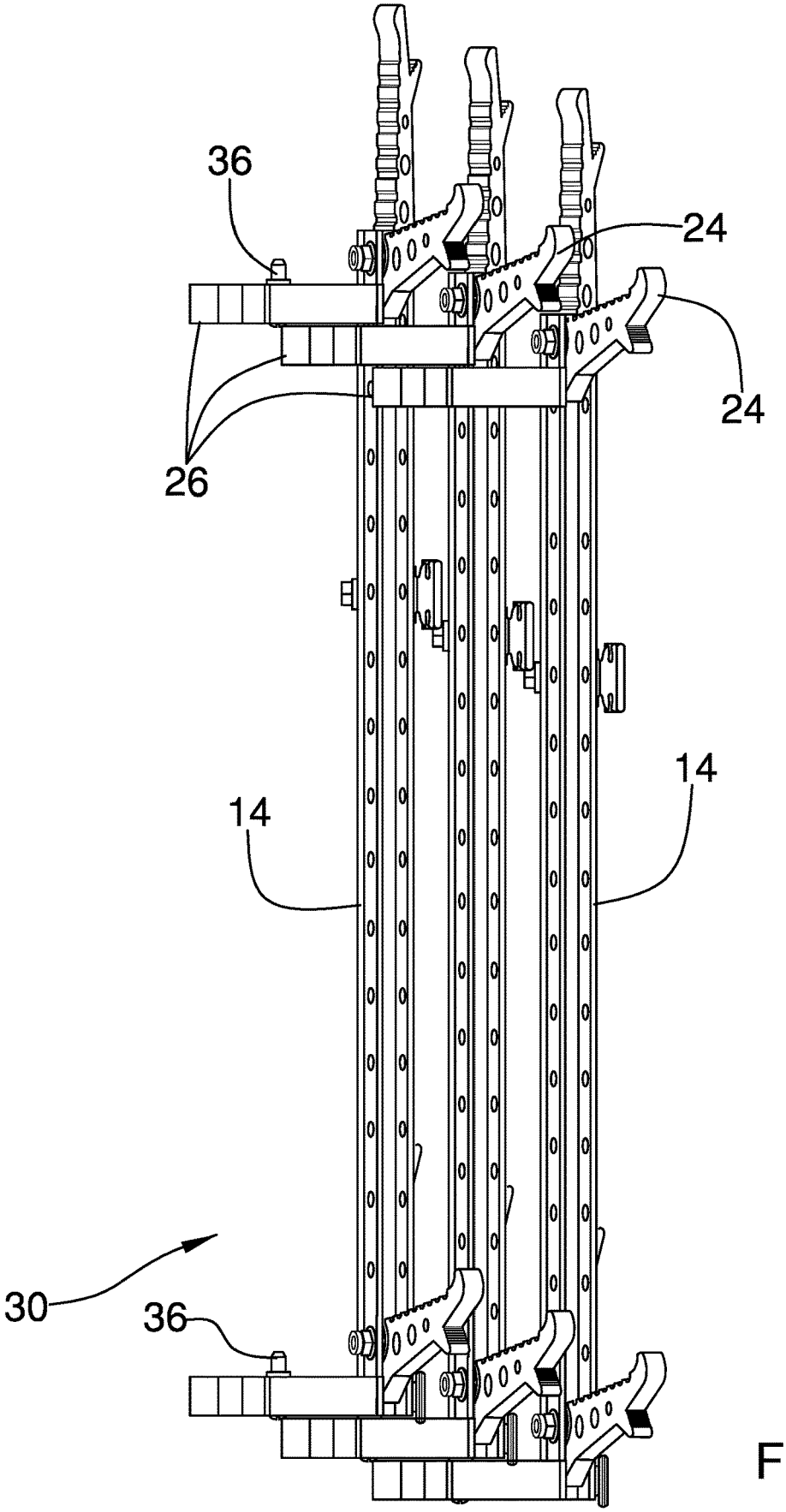
FIG. 16 is a side view of the embodiment of the disclosure as shown in FIG. 12 wherein a plurality tree climbing sticks is found in a nested condition.
Figure 17:
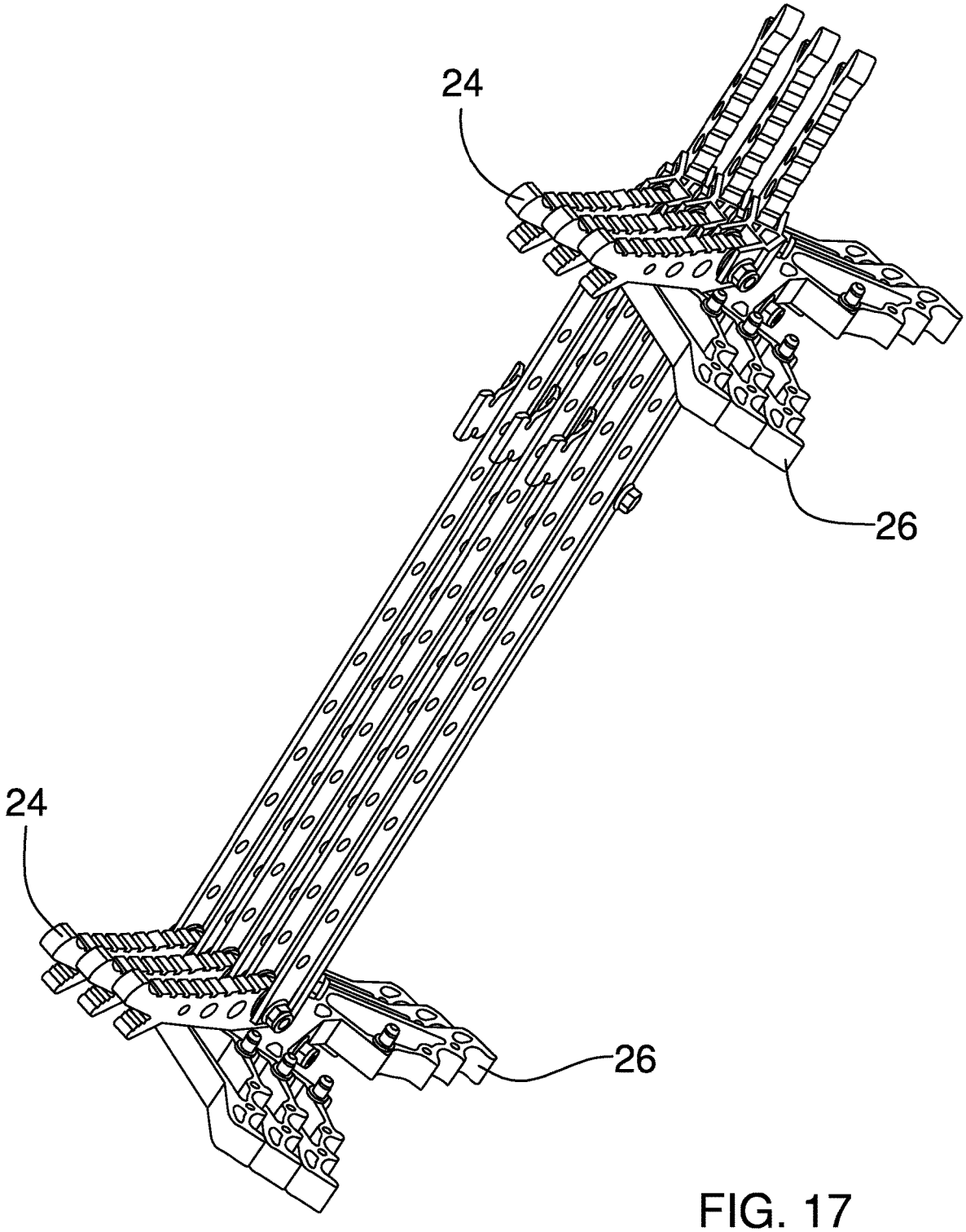
FIG. 17 is a front and top isometric view of the embodiment of the disclosure as shown in FIG. 16 wherein a plurality tree climbing sticks is found in a nested condition.
Figure 18:
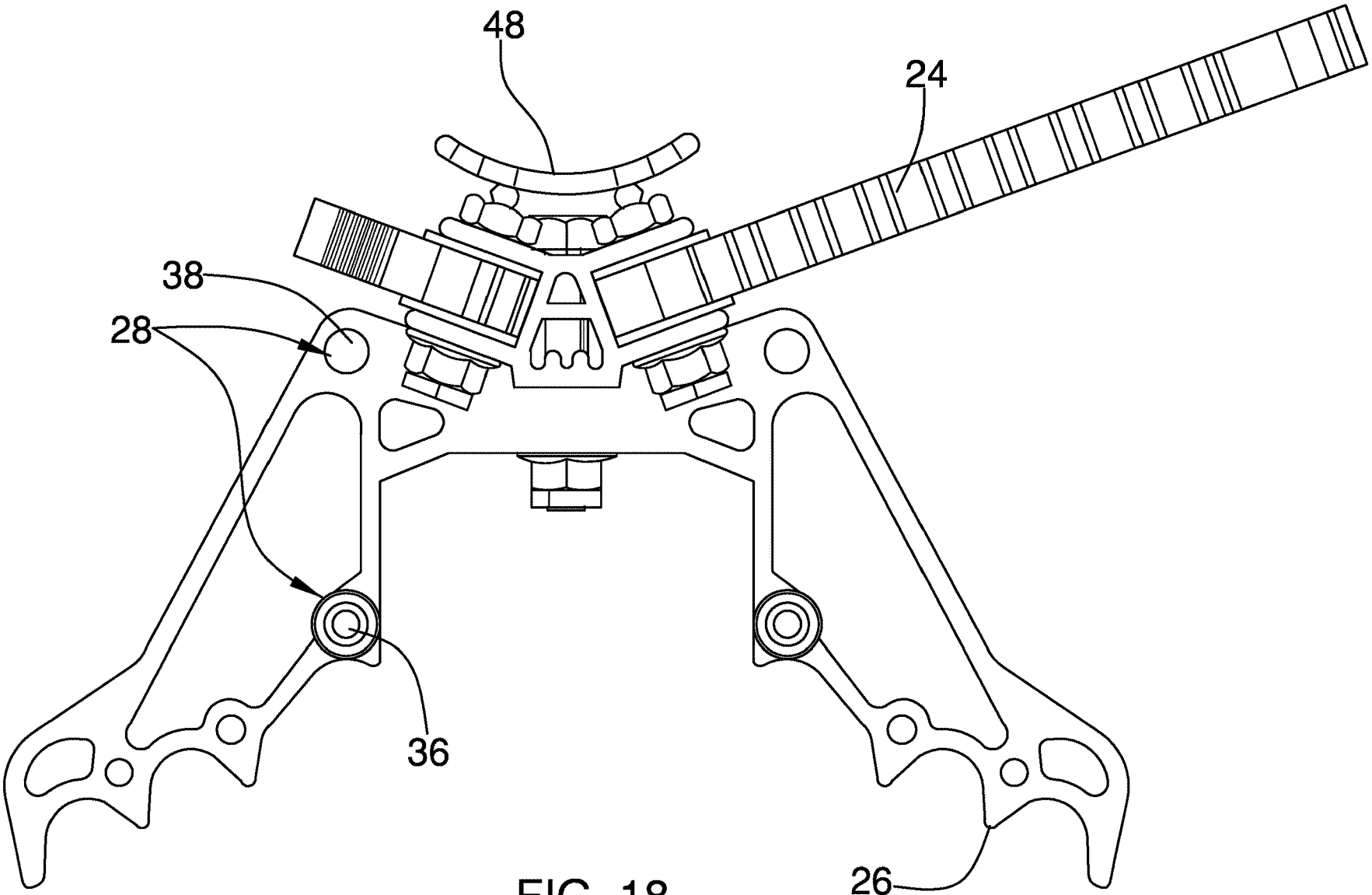
FIG. 18 is a top view of the embodiment of the disclosure as shown in FIG. 12.

The second mating member may comprise a receiver 38 that receives the post 36. The receiver 38 may include a well, sleeve, or other similar structure having a shape complimentary to a corresponding one of the posts 36. The second mating member 34 will be positioned to receive the first mating member 32 of another one of the tree climbing stick assemblies 12 and more specifically will be positioned such that the tree climbing stick assemblies 12 are nested with respect to each other. The receiver 38 will normally be vertically offset from the post 36 of each coupler 28 either forwardly or rearwardly to compensate for the width of the stick body 14 and another other structures thereon, wherein the front side 20 of one stick body 14 faces the rear side 22 of another stick body 14 for nesting and coupling according to the system 10. In a typical embodiment, this would position the stick bodies 14 in alignment with each other with the step 24 and/or 26 standoff for one tree climbing stick assembly 12 being positioned directly above or below the step and/or standoff of the next adjacent tree climbing stick assembly 12 as is shown in FIG. 10 wherein the standoffs 26 are positioned above each other from a most forward stick body 14 a most rearward stick body 14. For embodiments where the coupler includes a pair of posts 36, the second mating member 34 will include a pair of receivers 38 positioned as needed to be aligned with the posts 36.

Figure 8:
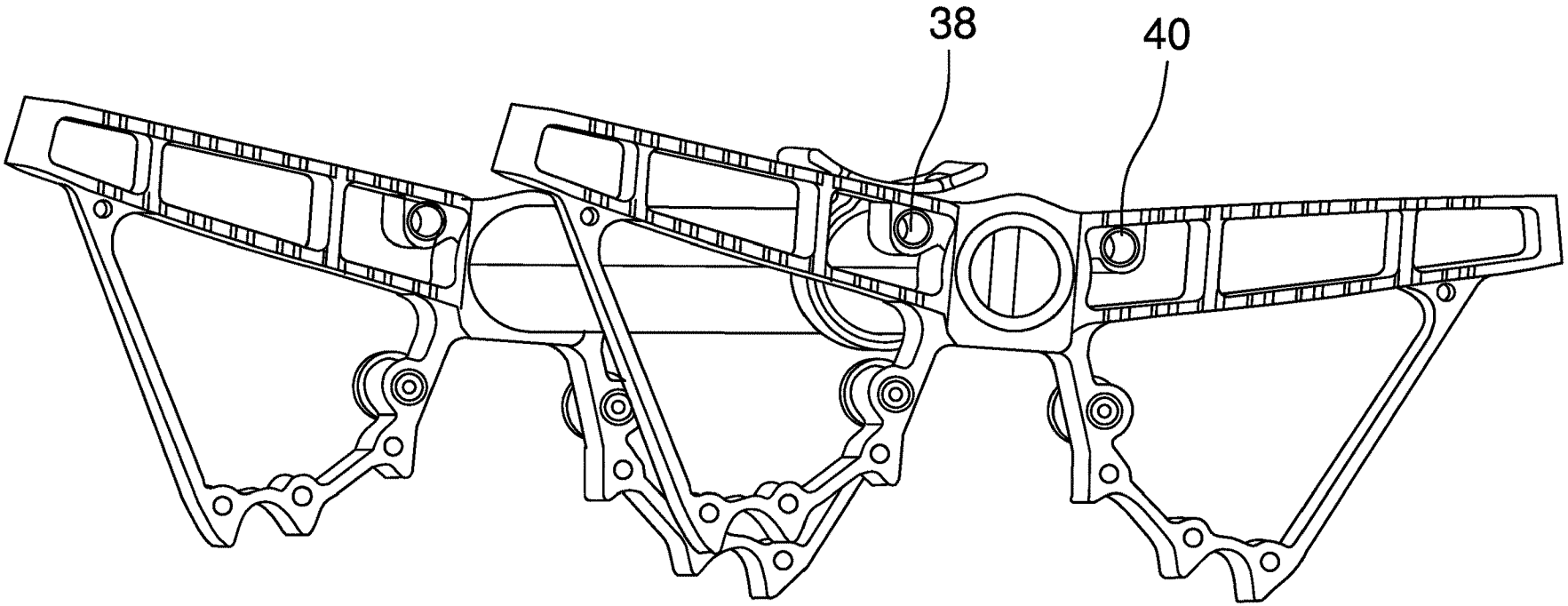
FIG. 8 is a partial, top isometric view of an embodiment of the disclosure.
Figure 9:
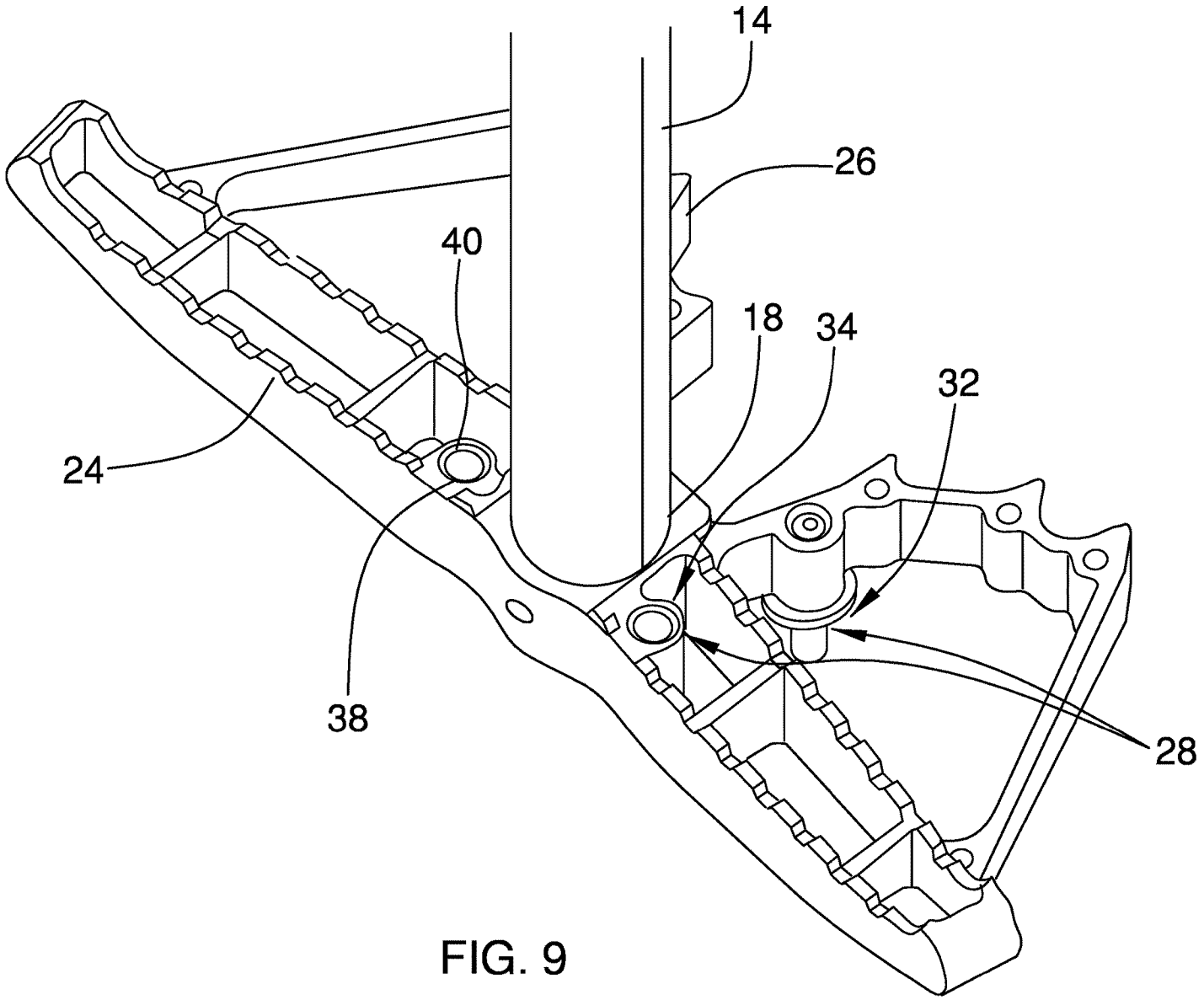
FIG. 9 is a partial, top isometric view of an embodiment of the disclosure.

As is shown in the Figures, and in particular FIG. 8, the receivers 38 may comprise an orifice having an upper section 40 including an inverted frusto-conical shape such that its diameter decreases as one moves inward of the receivers 38. This shape allows the posts 36 to be more easily guided and consequently inserted into the receivers 38. This shape further facilitates the pivoting of the tree stick 14 into a secured position for purposes that will be further explained below.

The coupler 28 may include a securing member 42 to resist the first mating member 32 from easily disengaging from the second mating member 34. Though the first mating member 32 may frictionally engage the second mating member 34 by way of material considerations and fit tolerances, the securing member 42 functions as a more controllable engagement than relying on friction between the post 36 and receiver 38 alone. The securing member 42 may include a resiliently compressible element positioned on the post 36 that compresses when the post 36 is extended into the receiver 38 to enhance frictional engagement between the post 36 and the receiver 38. For example, in one embodiment of the securing member 42, an O-ring of elastomeric material is extended around the post 38 and positioned within a slot in the post 38. An alternative example may include coating of the post 38 in resiliently compressible material.

The system 10 may include tree climbing stick assemblies 12 including a pair of couplers 28 wherein the couplers 28 are vertically spaced from each other to define an upper coupler 44 and a lower coupler 46. The upper 44 and lower 46 couplers 28 may each include single first 32 and second 34 mating members, a pair of first 32 and second 34 mating members, or a combination of one coupler 28 using single mating members and one coupler 28 utilizing dual mating members. Likewise, only some of the first mating members 32 may include the securing members 42 and all the first mating members 32 might not utilize the same structural type of securing members 42.

In some embodiments, the posts 36 of the upper coupler 44 may have a shorter vertical height than the posts 36 of the lower coupler 46, or vice versa. This will allow a person to first begin to extend the posts 36 of the lower coupler 46 into the receivers 38 of another lower coupler 46 with the upper end 16 of the stick body 14 tilted back. Once the posts 36 engage the receivers 38 of the lower coupler 46, the stick body 14 can be tilted forward against the other stick body 14 and the posts 36 of the upper coupler 44 extended into the receivers 38 of the other upper coupler 44. This structure therefore facilitates quick engagement of the tree climbing stick assemblies 12 and is further simplified by the shape of the upper sections 40 of the receivers 38. The receivers 38 of the upper couplers 44 may not require the frusto-conical upper sections 40 since the first mating members 32 of an upper coupler 44 will already be properly aligned with the second mating members 34 of the other upper coupler 44. It should be understood that the above structure may be reversed with the top coupler 44 having longer posts 36 and the frusto-conical upper sections 40.

The positioning of the couplers 28 on the stick body 14 may vary depending on several factors. As can be seen in the Figures, the couplers 28, or portions thereof, may be positioned on steps 24, standoffs 26 or both. Alternatively, a mount, not shown, may be attached to the stick body 14 for the sole purpose of supporting the first 32 and second 34 mating members. Thus, the receivers 38 may extend into the steps 24 as shown in FIGS. 1-11, or into the standoffs as is the case in FIGS. 12-18. The receivers 38 may extend completely through steps 24 or standoff 26, and may, furthermore, be attached to a peripheral edge thereof of a standoff 26 or step. The posts 36 may be attached to and extend downwardly from a bottom surface of the steps 24 or standoffs 26, or may be attached to and extend upwardly from the steps 24 or standoffs 26. In the embodiment of FIG. 1, the receivers 38 extend downwardly into the steps 24 while the posts extend downwardly from the standoffs 26. The embodiment of FIG. 12, however, has the posts 36 extending upwardly from the standoffs 26 and the receivers extending upwardly into the standoffs 26.

A button 48 may be attached to the rear side 22 of the stick body 12 and extend rearwardly therefrom. The button 48 is utilized for attachment to a tree by extending a tether around the tree and tying the tether to the button 48. The button 48 may further act as a saddle for receiving adjacent ones of the stick bodies 14 when the tree climbing stick assemblies 12 are secured together and therefore can be used to further stabilize the tree climbing stick assemblies 12, and mute sound from their abutment, when they are secured together.

In use, the tree climbing stick assembly 12 is used in a conventional manner wherein it is positioned adjacent to and coupled to a tree. This may be done with a tether attached to a button 48, or other connection point on the stick body 14, that is extended around the tree and tightened to securely hold the stick body 12 relative to the tree and such that the standoff 26 frictionally engages the tree. Typically, multiple ones of the tree climbing stick assemblies 12 are used together to form a ladder that is usable, for example, to climb upwardly to, and downwardly from, a tree stand or platform. The button 48 is positioned on the rear side 22 of the stick body 14 and has a distal surface facing away from the stick body assembly 12 which can act as a spacer and stabilizer between connected ones of the tree climbing sticks assemblies 12. The distal surface may be concavely arcuate to facilitate the action of a saddle to receive the front side 20 of a connected one of the tree climbing stick assemblies 12.

When the tree climbing stick assemblies 12 are not in use, they may be secured together to simplify transportation and storage. As shown in Figures with specific reference to FIGS. 10, 11, 16 and 17, a pair of stick bodies 14 is aligned such that the first mating members 32 of one tree climbing stick assembly 12 is aligned with the second mating member 34 of another tree climbing stick assembly 12. More specifically, in one embodiment, the first 32 and second 34 mating members to be aligned are those of the lower coupler 46. Because the posts 36 of the lower coupler 46 may be longer than those of the upper coupler 44, the free ends of the lower coupler 46 posts 36 are extended partially into the receivers 38 while leaving the stick bodies 14 free to pivot toward or away from each other. More specifically this allows the upper ends of the stick body 14 to be tilted toward or away from each other. Since the free ends of the posts 36 of the lower coupler 46 are in the receivers 38, the two stick bodies 14 are retained a same plane as they are tilted toward each other.

Once the two stick bodies 14 are vertically parallel to each other, the posts 36 of the upper coupler 44 are aligned with the receivers 38 of the other upper coupler 44. An upper one of the tree climbing stick assemblies 12 is then pushed downwardly on the other one of the tree climbing stick assemblies 12 to releasably secure there corresponding upper couplers 44 together. At this point, the tree climbing stick assemblies 12 define the secured tree sticks 30 as specified above. Additional tree climbing sticks assemblies 12 are attached to the secured tree sticks 30, typically one at a time, using the same process discussed above until all tree climbing stick assemblies 12 are secured together in a nested configuration. The reverse process disengages the tree climbing stick assemblies 12 from each other.

While the above process and structure may be preferred, a different embodiment may include the upper couplers 44 first being engaged before the lower couplers 46 and therefore the direction and positioning of the couplers 28 need not be germane to the function of the system 10. Particularly, the positioning of the couplers 28 generally allow the tree climbing stick assemblies 12 to be coupled and uncoupled with respect to each other utilizing a vertical motion when the longitudinal axes of the stick bodies 14 are vertically orientated. Such a motion is simplified in terms of speed and for ease of coupler alignment.

The connections of the couplers 28 of the adjacently nested ones of the tree climbing stick assemblies 12 prevents movements between them to eliminate noise. Additionally, the relative positioning of the tree climbing stick assemblies 12 to each other with the standoff 26 of one tree climbing stick assembly 12 being positioned over the standoff 26 of another tree climbing stick assembly 12 in a nested configuration facilitates the reduction of overall volume being required by a set of tree climbing stick assemblies 12 during storage and transportation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A nestable tree climbing stick system including a plurality of tree climbing stick assemblies, each of the tree climbing stick assemblies comprising:

a stick body having an upper end, a lower end, a front side and a rear side, the stick body having a longitudinal axis extending through the upper and lower ends;

a step being attached to the stick body and being configured for being stepped upon and gripped by a user of the tree climbing stick assemblies;

a standoff being attached to the stick body and being configured for engaging a surface of a tree, said standoff extending forward of said front side;

a pair of couplers being attached to said stick body and being vertically spaced from each other to define an upper coupler and a lower coupler, said pair of couplers being releasably engageable to the pair of couplers of another stick body for releasably securing together a pair of the tree climbing stick assemblies to define secured tree climbing sticks such that the longitudinal axes of the secured tree sticks are orientated parallel to each other and such that the front side of one of the tree climbing stick assemblies faces the rear side of the other of the tree climbing stick assemblies, said pair of couplers of the stick body nesting together with the pair of couplers of the other stick body and preventing movement of the pair of tree climbing stick assemblies relative to each other to facilitate storage and transportation thereof, each coupler of said pair of couplers including:

a first mating member, wherein said first mating member comprises a post extending downwardly relative to said upper end and having a bottom end, wherein said post is orientated generally parallel to the longitudinal axis of the stick body wherein an angle formed between said post and the longitudinal axis of the stick body is less than 20°; and a second mating member, said first mating member of one of the tree climbing stick assemblies being vertically engageable into the second mating member of another one of the tree climbing stick assemblies when the stick bodies of the secured tree sticks are vertically orientated, said second mating member comprising a receiver.

2. The nestable tree climbing stick system according to claim 1, further including a securing member being positioned on said first mating member, said securing member increasing friction between said first and second mating members.

3. The nestable tree climbing stick system according to claim 1, further including a button being mounted on said stick body and being engageable with a tether to secure the stick body to a tree, said button extending rearwardly of said rear side.

4. The nestable tree climbing stick system according to claim 1, wherein:

each tree climbing stick assembly includes:

the step being one of a pair of steps and the standoff being one of a pair of standoffs, each of the steps forming a unitary structure with one of the standoffs such that joined ones of the steps and the standoffs define supports; and one of the couplers being positioned on one of the supports and one of the couplers being positioned on another one of the supports;

each said first mating member is mounted on and extends downwardly from a bottom surface of an associated one of the pair of standoffs; and each said second mating member is mounted on and extends downwardly from an upper surface of an associated one of the pair of steps.

5. The nestable tree climbing stick system according to claim 4, further including a button being mounted on said stick body and being engageable with a tether to secure the stick body to a tree, said button extending rearwardly of said rear side.

6. A nestable tree climbing stick system including a plurality of tree climbing stick assemblies, each of the tree climbing stick assemblies comprising:

a stick body having an upper end, a lower end, a front side and a rear side, the stick body having a longitudinal axis extending through the upper and lower ends;

a step being attached to the stick body and being configured for being stepped upon and gripped by a user of the tree climbing stick assemblies;

a standoff being attached to the stick body and being configured for engaging a surface of a tree, said standoff extending forward of said front side;

a pair of couplers being attached to said stick body and being vertically spaced from each other to define an upper coupler and a lower coupler, said pair of couplers releasably securing together a pair of the tree climbing stick assemblies to define secured tree sticks such that the longitudinal axes of the secured tree sticks are orientated parallel to each other, each coupler of said pair of couplers including:

a first mating member, wherein said first mating member comprises a post extending downwardly relative to said upper end and having a bottom end, wherein said post is orientated generally parallel to the longitudinal axis of the stick body wherein an angle formed between said post and the longitudinal axis of the stick body is less than 20°; and a second mating member, said first mating member of one of the tree climbing stick assemblies being vertically engageable into the second mating member of another one of the tree climbing stick assemblies when the stick bodies of the secured tree sticks are vertically orientated, said second mating member comprising a receiver;

wherein the upper coupler is positioned nearer to said upper end of the stick body and the lower coupler is positioned nearer to said lower end of the stick body; and wherein said posts of said upper coupler are shorter than said posts of said lower coupler.

7. A nestable tree climbing stick system including a plurality of tree climbing stick assemblies, each of the tree climbing stick assemblies comprising:

a stick body having an upper end, a lower end, a front side and a rear side, the stick body having a longitudinal axis extending through the upper and lower ends;

a step being attached to the stick body and being configured for being stepped upon and gripped by a user of the tree climbing stick assemblies;

a standoff being attached to the stick body and being configured for engaging a surface of a tree, said standoff extending forward of said front side;

a pair of couplers being attached to said stick body and being vertically spaced from each other to define an upper coupler and a lower coupler, said pair of couplers releasably securing together a pair of the tree climbing stick assemblies to define secured tree sticks such that the longitudinal axes of the secured tree sticks are orientated parallel to each other, each coupler of said pair of couplers including:

a first mating member, wherein said first mating member comprises a post extending downwardly relative to said upper end and having a bottom end, wherein said post is orientated generally parallel to the longitudinal axis of the stick body wherein an angle formed between said post and the longitudinal axis of the stick body is less than 20°; and a second mating member, said first mating member of one of the tree climbing stick assemblies being vertically engageable into the second mating member of another one of the tree climbing stick assemblies when the stick bodies of the secured tree sticks are vertically orientated, said second mating member comprising a receiver;

wherein the upper coupler is positioned nearer to said upper end of the stick body and the lower coupler is positioned nearer to said lower end of the stick body; and wherein each tree climbing stick assembly includes:

a pair of the steps and a pair of the standoffs, each of the steps forming a unitary structure with one of the standoffs such that joined ones of the steps and the standoffs define supports; and one of the couplers being positioned on one of the supports and one of the couplers being positioned on another one of the supports.

8. A nestable tree climbing stick system including a plurality of tree climbing stick assemblies, each of the tree climbing stick assemblies comprising:

a stick body having an upper end, a lower end, a front side and a rear side, the stick body having a longitudinal axis extending through the upper and lower ends;

a step being attached to the stick body and being configured for being stepped upon and gripped by a user of the tree climbing stick assemblies;

a standoff being attached to the stick body and being configured for engaging a surface of a tree, said standoff extending forward of said front side;

a pair of couplers being attached to said stick body and being vertically spaced from each other to define an upper coupler and a lower coupler, said pair of couplers being releasably engageable to the pair of couplers of another stick body for releasably securing together a pair of the tree climbing stick assemblies to define secured tree climbing sticks such that the longitudinal axes of the secured tree sticks are orientated parallel to each other and such that the front side of one of the tree climbing stick assemblies faces the rear side of the other of the tree climbing stick assemblies, said pair of couplers of the stick body nesting together with the pair of couplers of the other stick body and preventing movement of the pair of tree climbing stick assemblies relative to each other to facilitate storage and transportation thereof, each coupler of said pair of couplers including:

a first mating member, wherein said first mating member comprises a post extending downwardly relative to said upper end and having a bottom end, wherein said post is orientated generally parallel to the longitudinal axis of the stick body wherein an angle formed between said post and the longitudinal axis of the stick body is less than 20°; and a second mating member, said first mating member of one of the tree climbing stick assemblies being vertically engageable into the second mating member of another one of the tree climbing stick assemblies when the stick bodies of the secured tree sticks are vertically orientated, said second mating member comprising a receiver; and a button being mounted on said stick body and being engageable with a tether to secure the stick body to a tree, said button extending rearwardly of said rear side.

* * * * *